US011933577B1

(12) United States Patent
Robinson

(10) Patent No.: US 11,933,577 B1
(45) Date of Patent: Mar. 19, 2024

(54) WATER ASSISTED LAUNCHING CANNON

(71) Applicant: Aaron Robinson, Andover, MN (US)

(72) Inventor: Aaron Robinson, Andover, MN (US)

( * ) Notice: Subject to any disclaimer, the term of this patent is extended or adjusted under 35 U.S.C. 154(b) by 0 days.

(21) Appl. No.: 18/140,767

(22) Filed: Apr. 28, 2023

(51) Int. Cl.
*F41B 11/00* (2013.01)
*F41B 11/71* (2013.01)
*F41B 11/723* (2013.01)
*F41B 11/89* (2013.01)

(52) U.S. Cl.
CPC ..... *F41B 11/89* (2013.01); *F41B 11/71* (2013.01); *F41B 11/723* (2013.01)

(58) Field of Classification Search
CPC ..... F41B 11/723; F41B 11/64; F41B 11/89; F41B 11/54
USPC ..... 124/66, 73, 78, 56
See application file for complete search history.

(56) References Cited

U.S. PATENT DOCUMENTS 899,448 A * 9/1908 Groble ..... F41B 7/006 43/42.02
970,018 A * 9/1910 Coleman ..... F41B 7/006 124/67
2,600,883 A * 6/1952 King ..... F41B 7/00 124/63
2,633,119 A * 3/1953 Bauderer ..... F41B 7/08 446/54
2,944,822 A * 7/1960 Brown ..... F41B 7/003 273/446
2,962,837 A * 12/1960 Lemelson ..... A63H 5/04 124/31
3,166,321 A * 1/1965 Fleishman ..... A63B 65/122 124/27
4,086,901 A * 5/1978 Clement ..... F41B 5/0073 473/569
4,922,884 A * 5/1990 Ford ..... F41B 3/02 124/20.1
5,373,833 A * 12/1994 D'Andrade ..... F41B 11/00 124/73
5,553,598 A * 9/1996 Johnson ..... F41B 11/681 124/63
5,979,424 A * 11/1999 Alvarez ..... F41B 7/08 124/16
6,192,612 B1 * 2/2001 Maier ..... F41A 1/04 89/14.6
6,953,033 B2 * 10/2005 Vanek ..... F41B 7/00 124/16
6,972,774 B2 * 12/2005 Eguchi ..... H04N 1/3873
7,331,337 B2 2/2008 Cuisinier
7,448,371 B2 * 11/2008 Sapir ..... F41B 7/08 124/16
7,721,722 B1 * 5/2010 Tulkis ..... F41B 11/681 124/73

(Continued)

*Primary Examiner* — Michael D David
(74) *Attorney, Agent, or Firm* — Merchant & Gould P.C.

(57) ABSTRACT

A water balloon cannon including a barrel with a bore diameter designed to receive a water balloon. The barrel extends between a muzzle and a rear portion, where the rear portion defines a compressed air port and a water port. The water balloon cannon further includes a water valve for introducing a volume of water through the water port into the rear portion of the bore diameter, and an air valve for introducing a flow of compressed air through the compressed air port into the rear portion of the bore diameter. The volume of water is designed to act as a buffer between the flow of compressed air and the water balloon positioned within the bore diameter.

19 Claims, 18 Drawing Sheets

(56) References Cited

U.S. PATENT DOCUMENTS

| | | | | |
|---|---|---|---|---|
| 7,726,292 | B1 | 6/2010 | Coleman | |
| 7,789,080 | B2 * | 9/2010 | Fielding, Jr. | A01K 81/00 273/350 |
| 8,074,838 | B1 | 12/2011 | Tate | |
| 8,393,299 | B1 * | 3/2013 | Bernat | F41B 7/003 42/70.11 |
| 9,038,616 | B2 * | 5/2015 | Phillips | A63H 33/18 124/61 |
| 9,713,775 | B2 * | 7/2017 | Cogliandro | A63H 5/04 |
| 2008/0173291 | A1 * | 7/2008 | Halmone | F41B 11/721 124/71 |
| 2013/0316611 | A1 * | 11/2013 | Phillips | A63H 33/00 446/176 |

* cited by examiner (Section AA)

WATER ASSISTED LAUNCHING CANNON

TECHNICAL FIELD

The present disclosure relates generally to water balloon launchers, and more particularly to a water assisted pneumatically powered water balloon launching cannon and associated methods.

BACKGROUND

Water balloons are a great enjoyment for people of all ages especially when the weather is hot. They are often used in water fights or water wars typically accompanied with water guns. Although water balloons are limited in engagement due to the limitations of human's ability to propel more than 10-20 yards, a variety of water balloon launching devices exist today for the amusement of children and adults. These devices have configurations ranging from slings to slingshots, and from lacrosse rackets to jai-alai cestas. All of these devices are effective at hurling a water balloon farther than human factors would naturally permit. However, these configurations rely on human strength as the propelling force of the water balloon, which is limited. In addition to human-powered water balloon launching devices, automated water balloon launching devices exist, such as that disclosed in U.S. Patent Publ. No. 2013/0316611, the contents of which are incorporated by reference to the extent that they do not conflict with the teachings herein. Among the notable drawbacks of current automated water balloon launching devices is that they are unreliable, and often the water balloon ruptures while still in the barrel, causing the water balloon launching device to misfire.

SUMMARY

Embodiments of the present disclosure provide a water balloon launcher that uses compressed air as the propelling force, with a buffer of water positioned adjacent to the balloon to protect the balloon from the shock of compressed air during the launch. In some embodiments, the buffer of water can aid in absorbing vibrational energy and/or dampening or dissipating a shock from the compressed air, which can otherwise cause the balloon to tear or rupture. In embodiments, the water balloon launcher can be adjusted to control the amount of water used in the buffer system, allowing users to fine-tune the device for optimal performance. Additionally, the water balloon launcher can be designed with adjustable pressure controls to ensure that the compressed air is delivered at the correct pressure, which can further help to prevent the balloon from rupturing during launch. The water balloon launcher provides an efficient and safe way to enjoy water balloon fights, and can be used for recreational activities, parties, or other events where water balloon launching is desired.

One aspect of the disclosure provides a water balloon cannon, including a barrel defining a bore diameter sized to receive a water balloon and extending between a muzzle and a rear portion, the rear portion defining a compressed air port and a water port, and a water valve configured to introduce a volume of water through the water port into the rear portion of the bore diameter. In some embodiments, the water balloon can further include an air valve configured to introduce a flow of air through the compressed air port into the rear portion of the bore diameter. In some embodiments, the volume of water is configured to provide a buffer between the flow of compressed air through the compressed air port and a water balloon positioned within the bore diameter.

Another aspect of the present disclosure provides a water balloon cannon, including a barrel defining a bore diameter extending between a muzzle and a rear or breach portion, a water holding chamber, a first valve configured to selectively open a fluid conduit between the water holding chamber and a water source, a second valve configured to selectively open a fluid conduit between the water holding chamber and a compressed air source, and a third valve configured to selectively open a fluid conduit between the water holding chamber and the breach portion of the barrel.

In some embodiments, the water valve provides a conduit fluidly coupling the barrel with a water source. In some embodiments, the water source is at least one of a pressurized water hose or a replenishable water tank. In some embodiments, the water valve is electrically controllable between an open position enabling a flow of water through the water port, and a closed position inhibiting a flow of water through the water port. In some embodiments, the water valve is automatically transitioned from the closed position to the open position and back to the closed position over a determined length of time. In some embodiments, the determined length of time is adjustable.

In some embodiments, the air valve provides a conduit fluidly coupling the barrel with a compressed air source. In some embodiments, the compressed air source is at least one of an air recharge tank or an air compressor. In some embodiments, the air valve is electrically controllable between an open position enabling a flow of compressed air through the compressed air port, and a closed position inhibiting a flow of air through the compressed air port. In some embodiments, the water valve is automatically transitioned from the closed position to the open position and back to the closed position over a determined length of time. In some embodiments, the determined length of time is adjustable.

In some embodiments, the water balloon cannon further includes an air recharge tank in fluid communication with the air valve. In some embodiments, the air recharge tank includes a pressure relief safety valve. In some embodiments, the air recharge tank includes an inlet configured to be fluidly connected to a compressed air source. In some embodiments, the water balloon cannon further includes a pressure sensor configured to monitor a pressure inside the air recharge tank.

In some embodiments, the barrel is constructed of at least one of a polyvinyl chloride material, plastic material, or composite material. In some embodiments, the bore diameter of the barrel defines a rifling pattern configured to at least one of improve accuracy or increase a projectile range of the water balloon cannon. In some embodiments, the barrel includes a muzzle break configured to at least one of reduce recoil or improve accuracy of the water balloon cannon.

In some embodiments, the water balloon cannon further includes a battery configured to provide electrical power to at least one of the water valve, an air valve, a timing circuit, or one or more indicator lights. In some embodiments, the water cannon further includes a power switch configured to selectively disconnect the battery from at least one of the water valve, the air valve, the timing circuit, or the one or more indicator lights. In one embodiment, the water balloon cannon further includes an electrical circuit configured to open an air valve for a first length of time, and subsequently to open the water valve for a second length of time. In one embodiment, the water balloon cannon further includes at least one indicator light configured to illuminate when the water balloon cannon is ready to be fired.

In some embodiments, the water balloon cannon further includes a structural casing configured to support at least one of the barrel, water valve, recharge tank, etc. In some embodiments, the structural casing comprises a first part and a second part defining a plurality of ribs configured to provide supporting contact to at least one of the barrel, water valve, recharge tank, etc. In some embodiments, the structural casing defines one or more mounting supports configured to enable mounting of the water balloon cannon to a stable platform. In some embodiments, the water balloon cannon further includes a dual spade grip handle. In some embodiments, the water balloon cannon further includes a trigger. In some embodiments, the trigger is electrically coupled to at least one of the water valve or an air valve, wherein activation of the trigger causes an air valve to open, and wherein release of the trigger causes the air valve to close and the water valve to open for a determined length of time.

Yet another aspect of the present disclosure provides a method of launching a water balloon, including partially filling a barrel of a water balloon cannon with a volume of water positioned adjacent to a water balloon, and subsequently introducing a flow of compressed air into the barrel, thereby launching the water balloon from the barrel, with the volume of water providing a buffer between the flow of compressed air and the water balloon to inhibit rupture of the water balloon during the launch sequence.

A variety of additional inventive aspects will be set forth in the description that follows. The inventive aspects can relate to individual features and to combinations of features. It is to be understood that both the forgoing general description and the following detailed description are exemplary and explanatory only and are not restrictive of the broad inventive concepts upon which the embodiments disclosed herein are based.

BRIEF DESCRIPTION OF THE DRAWINGS

The accompanying drawings, which are incorporated in and constitute a part of the description, illustrate several aspects of the present disclosure. A brief description of the drawings is as follows.

DETAILED DESCRIPTION

Reference will now be made in detail to exemplary aspects of the present disclosure that are illustrated in the accompanying drawings. Wherever possible, the same reference numbers will be used throughout the drawings to refer to the same or like parts.

Figure 11:
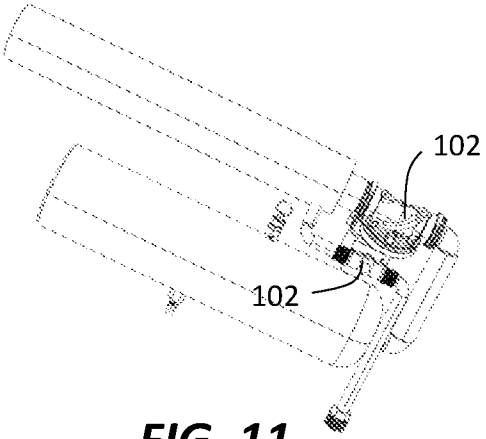
FIG. 11 is a perspective view depicting a water balloon cannon, in accordance with an embodiment of the disclosure.
Figure 12:
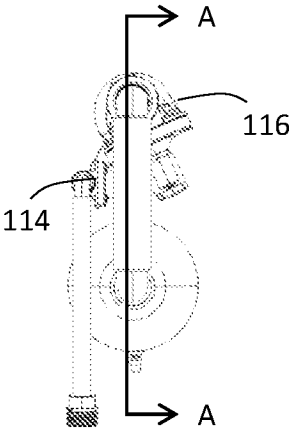
FIG. 12 is a rear plan view of the water balloon cannon of FIG. 11, in accordance with an embodiment of the disclosure.

Referring to FIGS. 1-6, a water balloon cannon 100 is depicted in accordance with an embodiment of the disclosure. With additional reference to FIGS. 11-13, in some nonlimiting embodiments, the water balloon cannon 100 can include a barrel 102, water valve 114, and air valve 116 configured to cooperate to launch a water balloon 50 under the power of compressed air. The barrel 102 can define a bore diameter 104 extending between a muzzle 106 and a rear portion 108. The rear portion 108 can define a compressed air port 110 and a water port 112. The water valve 114 can introduce a volume of water 52 into the rear portion 108 of the bore diameter 104 through the water port 112. The air valve 116 can introduce a flow of air into the rear portion 108 of the bore diameter 104 through the compressed air port 110, thereby launching the water balloon 50 from the muzzle 106 of the barrel 102.

In embodiments, the volume of water 52 can aid in absorbing vibrational energy and/or dampening or dissipating a shock from the compressed air, which may otherwise cause the water balloon 50 to tear or rupture during the launch sequence. Moreover, in contrast to water balloon launching devices of the prior art, in the event of a mechanical failure, embodiments of the present disclosure are designed to expel only water and air from the muzzle 106. In other words, embodiments of the present disclosure include no rigid components positioned between the flow of compressed air and the water balloon 50 during operation. Other advantages of embodiments of the present disclosure include its compact packaging, ease of use and maintenance, and general reliability during prolonged operation or repeated uses.

Figure 7:
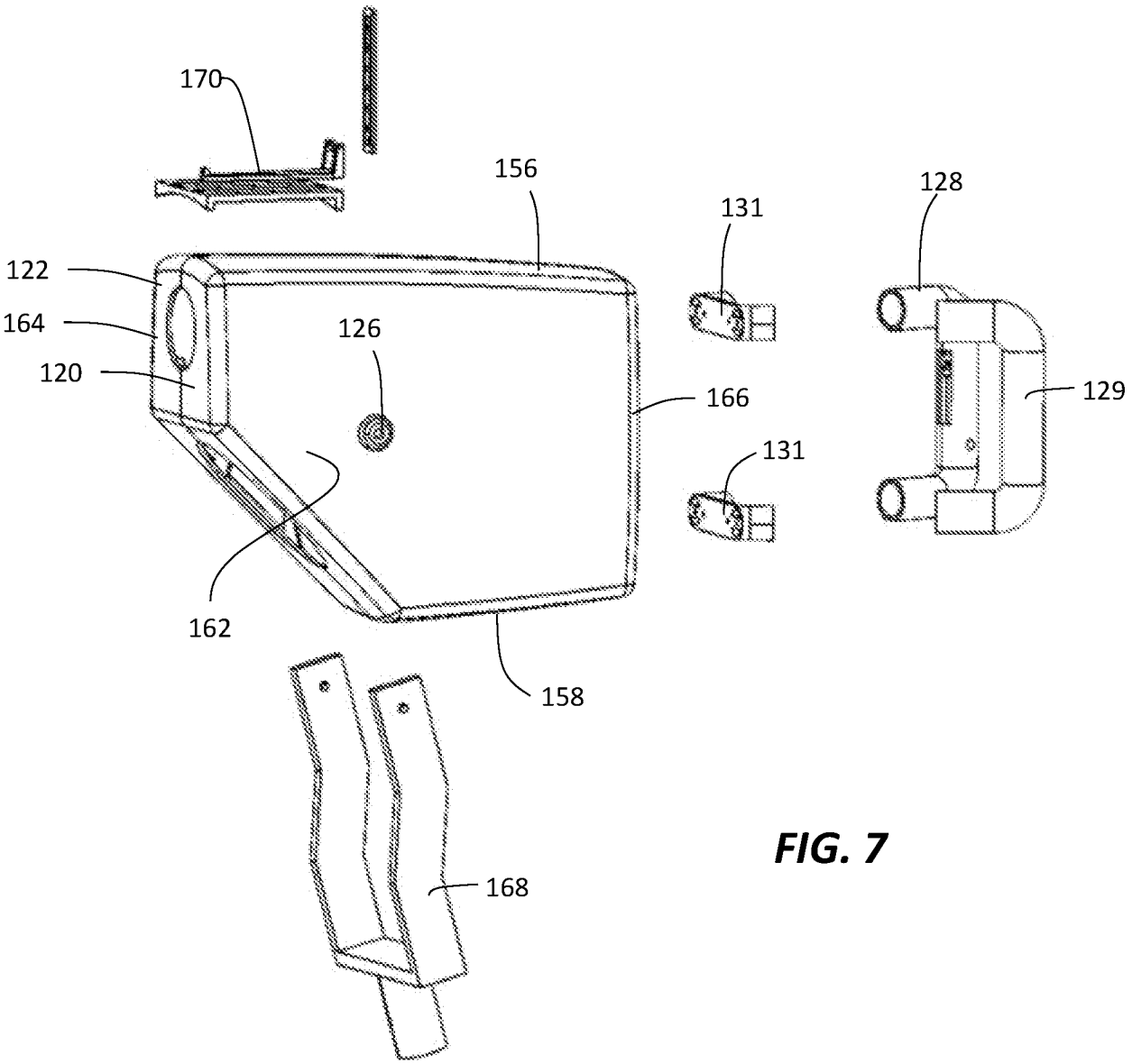
FIG. 7 is an exploded, perspective view depicting a structural casing and handle components of a water balloon cannon, and accordance with an embodiment of the disclosure.

With additional reference to FIG. 7, the water balloon cannon 100 can include a structural casing 118 that supports the components of the water balloon cannon 100, including the barrel 102, water valve 114, air valve 116, and other components. As depicted, the structural casing 118 can be represented as a three-dimensional shape generally including a top surface 156, bottom surface 158, right side surface 160, left side surface 162, front surface 164 and rear surface 166. In embodiments, the structural casing 118 can act as a rigid support for the components, reducing the need for an internal frame, resulting in an overall weight savings in comparison to water balloon launching cannons of the prior art.

In embodiments, the structural casing 118 can be composed of two parts, including a first part 120 and a second part 122 (e.g., right-hand and left-hand components, etc.), which can be fused or fastened together to form the completed structural casing 118. In embodiments, the interior of the structural casing 118 can be reinforced with one or more ribs, which can be cut or formed to fit and support the components of the water balloon cannon 100, as well as to provide structural rigidity to the structural casing 118. The structural casing 118 can be made of a variety of materials, including PVC, ABS plastic, composite material, and others.

Figure 1:
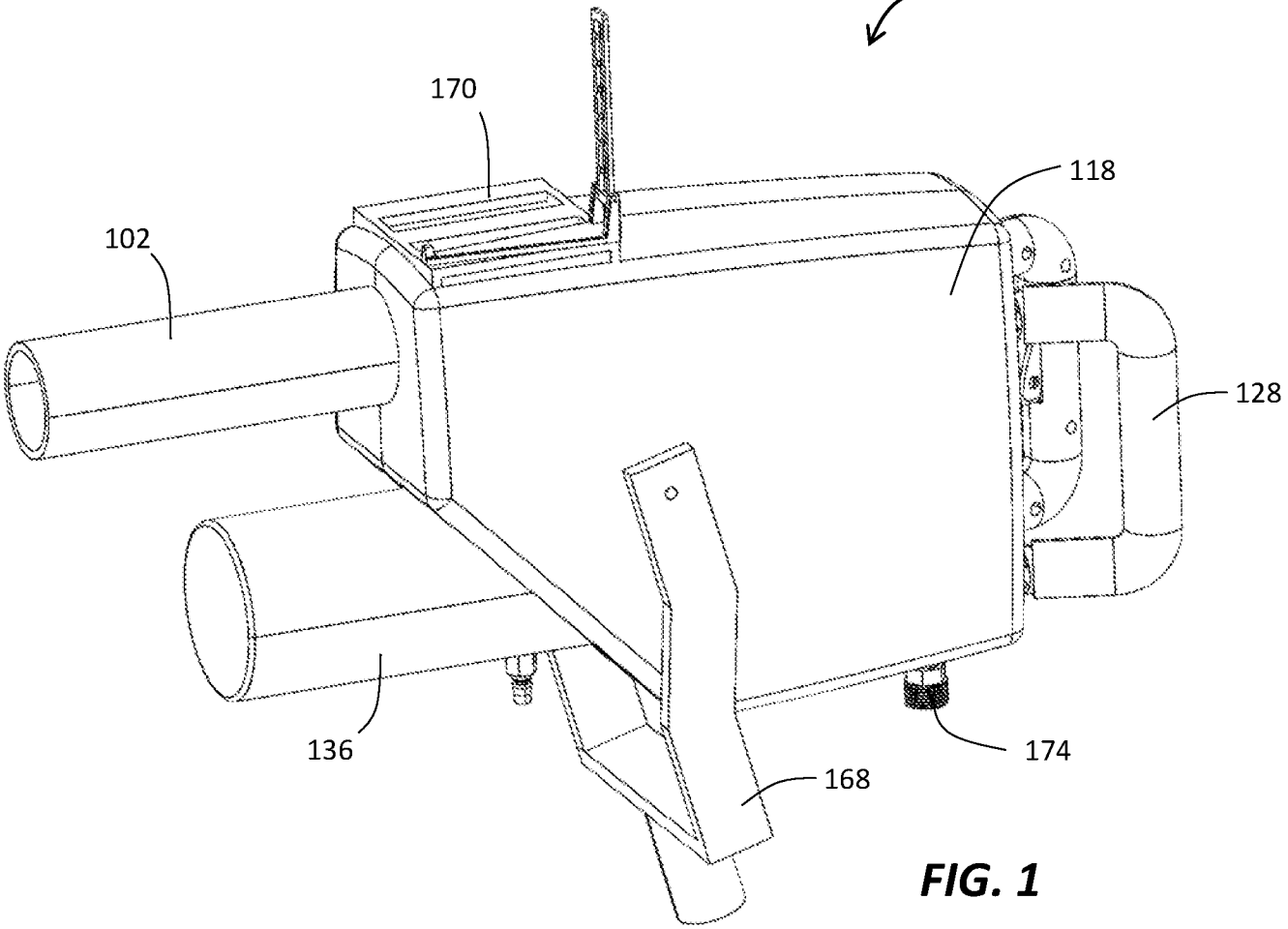
FIG. 1 is a perspective view depicting a water balloon cannon, in accordance with an embodiment of the disclosure.
Figure 2:
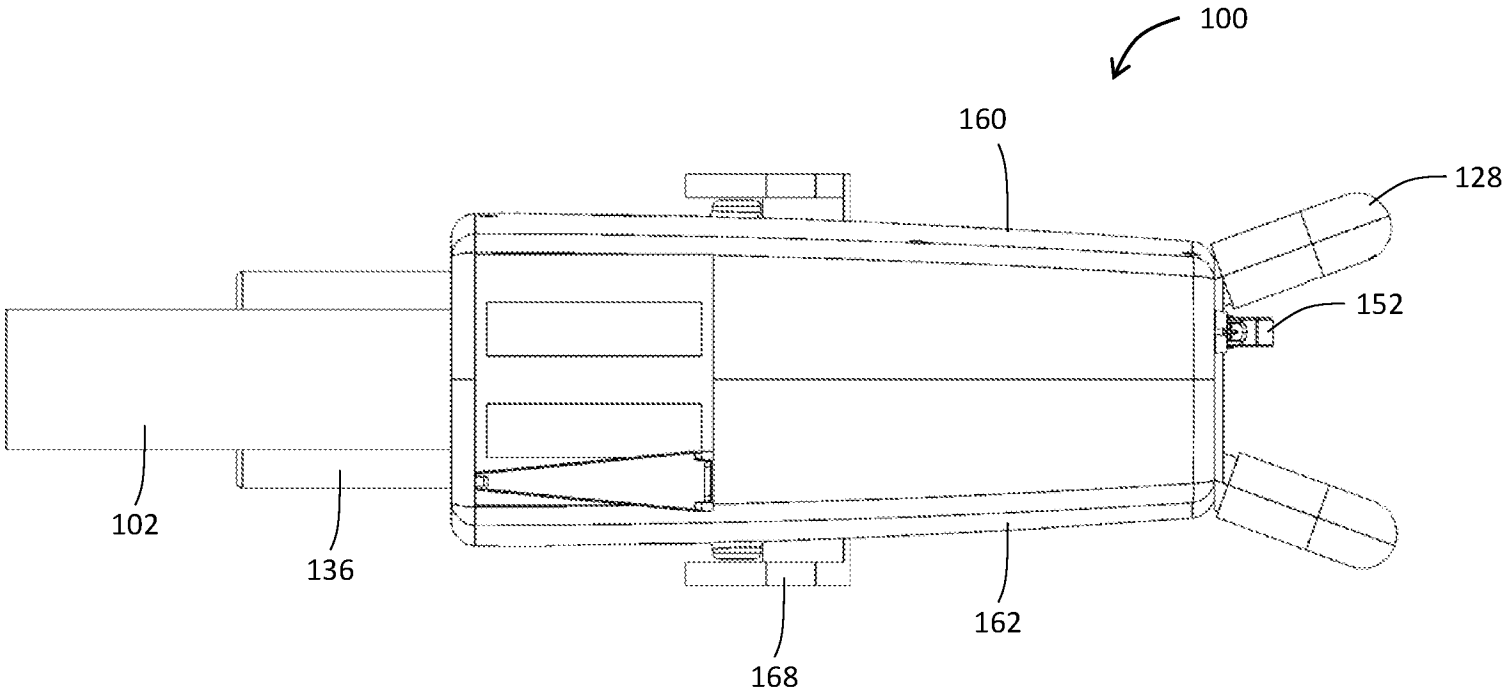
FIG. 2 is a top plan view depicting the water balloon cannon of FIG. 1, in accordance with an embodiment of the disclosure.
Figure 3:
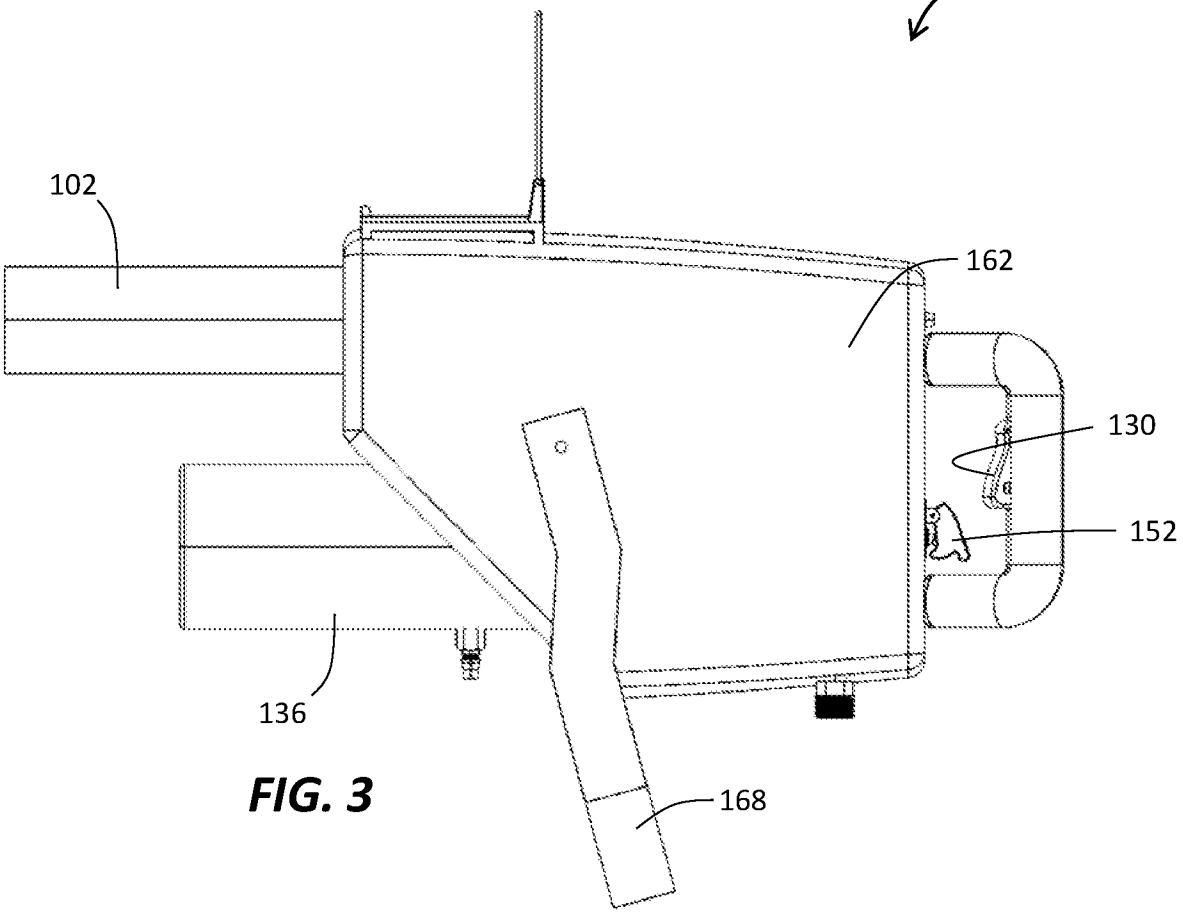
FIG. 3 is a left side profile view depicting the water balloon cannon of FIG. 1, in a substantially horizontally oriented position with respect to a gravitational frame of reference, in accordance with an embodiment of the disclosure.
Figure 4:
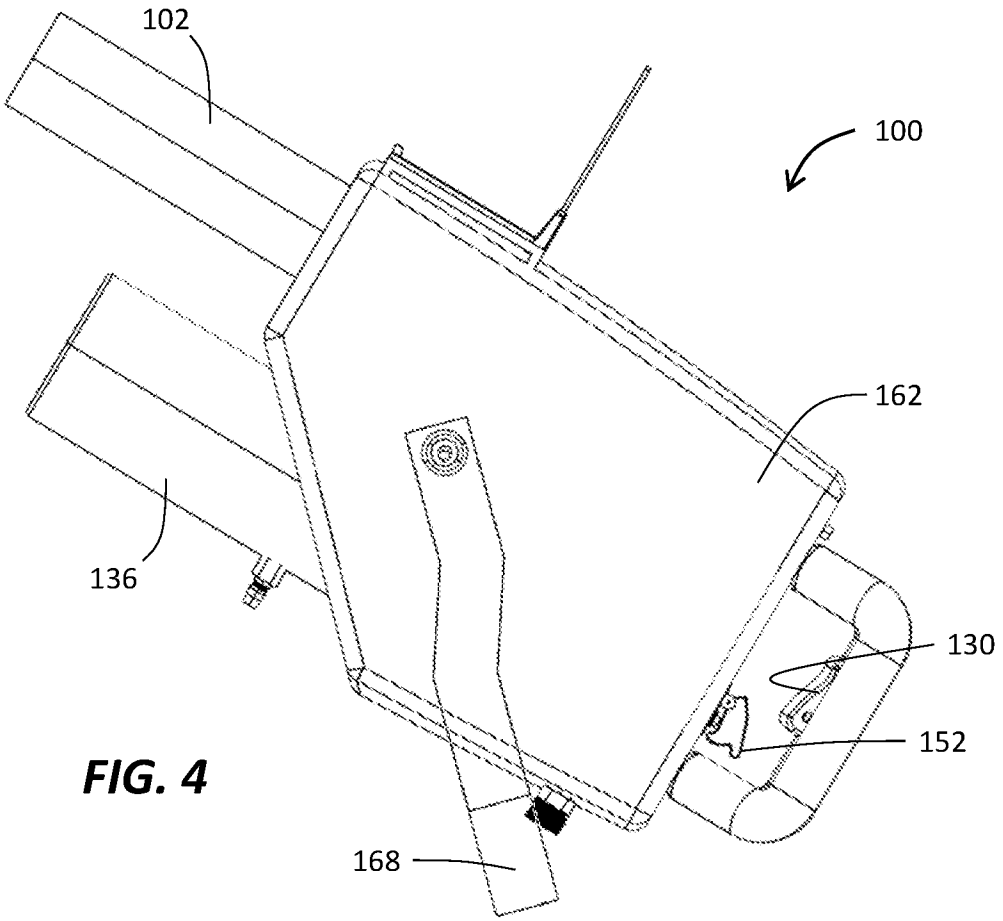
FIG. 4 is a left side profile view depicting the water balloon cannon of FIG. 3 in a tilted position with respect to a gravitational frame of reference, in accordance with an embodiment of the disclosure.
Figure 6:
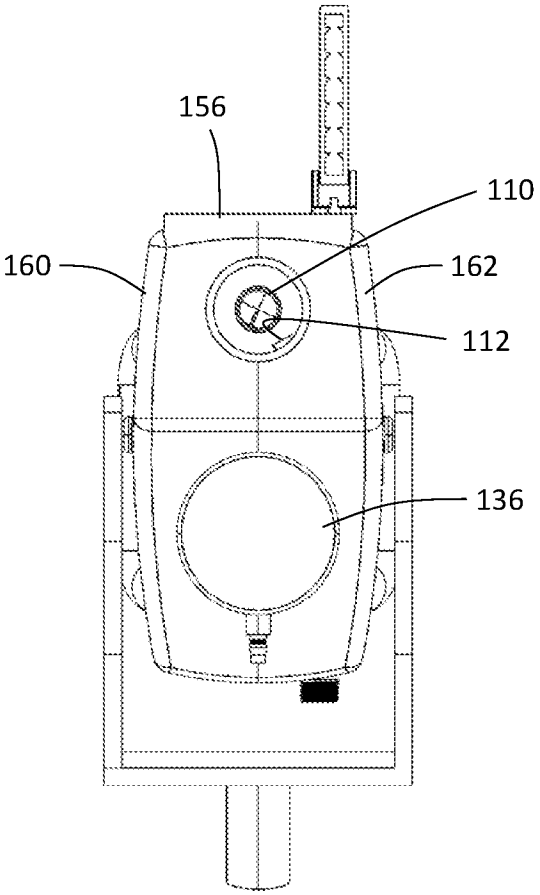
FIG. 6 is a front plan view depicting the water balloon cannon of FIG. 1, in accordance with an embodiment of the disclosure.
Figure 5:
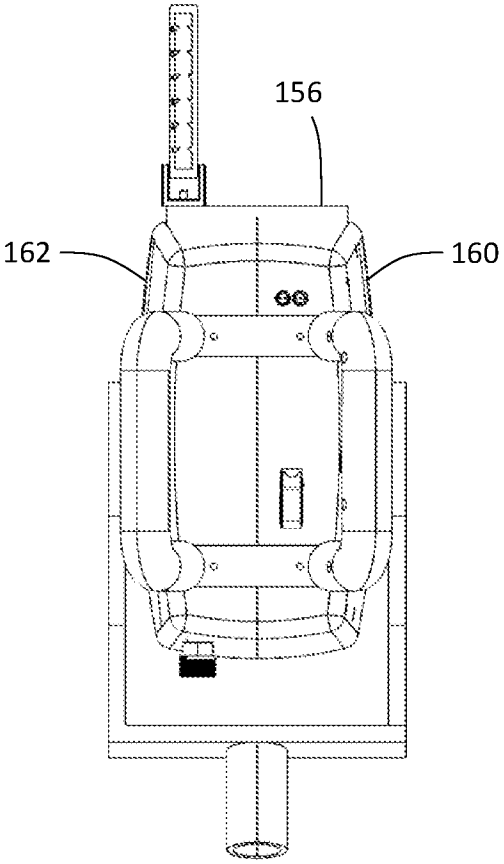
FIG. 5 is a rear plan view depicting the water balloon cannon of FIG. 1, in accordance with an embodiment of the disclosure.

In some embodiments, the structural casing 118 can include one or more mount supports 126 that allow for the water balloon cannon 100 to be removably mounted to a stable platform, such as a tripod or deck railing. For example, in the depicted embodiment, the water balloon cannon 100 is mounted to a pivotable base 168 configured to enable the water balloon cannon 100 to pivot relative to a fixed frame of reference. In some embodiments, the pivotable base 168 is configured to enable lateral pivoting of the water balloon cannon 100 to enable panning from side to side, as well as pivoting along a plane substantially orthogonal to the lateral pivoting frame to enable the muzzle 106 to be elevated relative to the fixed frame of reference (as depicted in FIGS. 3-4), which can affect the trajectory of a water balloon 50 launched from the water balloon cannon 100. To aid in aiming of the water balloon cannon 100, one or more aiming sights 170 can be provided.

To aid in manipulation of the water balloon cannon 100, the water balloon cannon 100 can be equipped with a handgrip or handle 128 (e.g., a dual spade grip handle, etc.), including a grip portion 129 and a mounting portion 131, which can be mounted on a portion (e.g., rear surface 166, etc.) of the structural casing 118. In some embodiments, the handle 128 can include two grip portions 129 that can be shaped like spades or paddles. In embodiments, the grip portions 129 can be positioned on either side of the barrel 102 or structural casing 118 to allow for control over the direction and elevation of the water balloon cannon 100.

As best depicted in FIGS. 3-4, the water balloon cannon 100 can also include a trigger 130 or other momentary push button switch, such as a trigger, for activating the cannon. As further described below in connection with FIG. 14, the trigger 130 can be electrically connected to at least one of the water valve 114 or air valve 116, such that when the trigger 130 is activated, the air valve 116 transitions to an open position. Upon release of the trigger 130, or after a determined length of time, the air valve 116 transitions to a closed position and the water valve 114 transitions to an open position for a specified length of time.

Referring now to FIGS. 8-13, in some embodiments, the bore diameter 104 of the barrel 102 can be sized to accommodate a standard sized water balloon 50. For example, in some embodiments, the bore diameter 104 can measure between about 2-3 inches. The length of the barrel 102, extending between the muzzle 106 and the rear portion 108, can measure about 20 inches or less, although other lengths are also contemplated.

The muzzle 106 represents the end of the barrel 102 in the form of a circular or tubular opening into the bore diameter 104, although the use of a slotted barrel is also contemplated. In some embodiments, water balloons can be loaded into the barrel 102 through the muzzle 106. The barrel 102 can be constructed of materials such as polyvinyl chloride, plastic, or composite material. Additionally, in some embodiments, the bore diameter 104 of the barrel 102 can have a rifling pattern, designed to improve accuracy or increase the projectile range of the water balloon cannon. In some embodiments, the barrel 102 can include a muzzle break to reduce recoil and improve accuracy.

Figure 8:
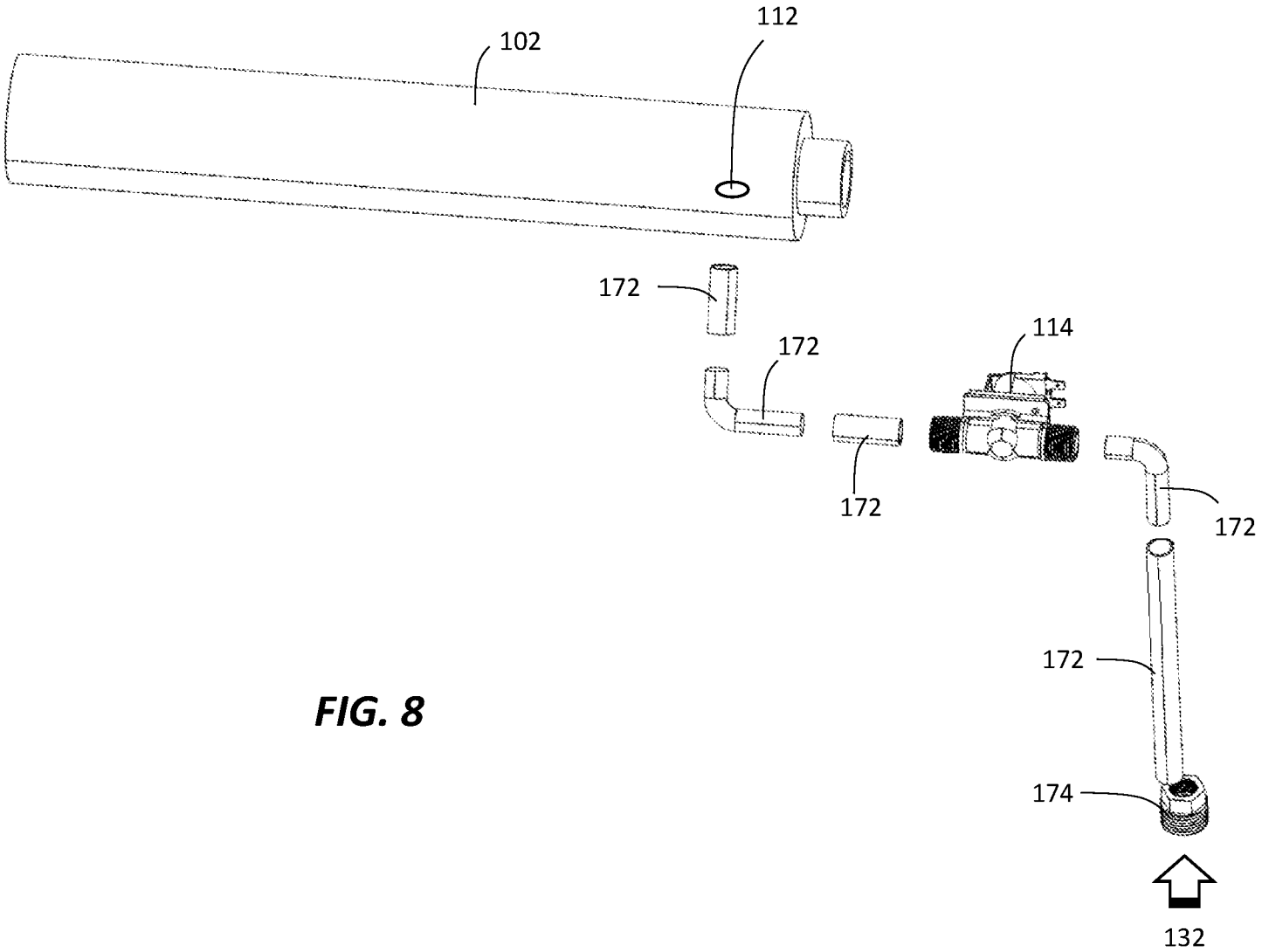
FIG. 8 is an exploded, perspective view depicting water source components of a water balloon cannon, in accordance with an embodiment of the disclosure.

As depicted in FIG. 8, the water valve 114 provides a fluid connection between the barrel 102 and a water source 132, which can be a pressurized water hose or a replenishable water tank. As depicted, in some embodiments, one or more sections of conduit 172 can fluidly couple the water source 132 to the water valve 114 to the water port 112. In some embodiments, at least one section of the conduit 172 can define a coupling 174 (e.g., threaded, quick disconnect, etc.) enabling fluid connection to the water source 132. In some embodiments, the water balloon cannon 100 can alternatively include a water pump, for example, in place of or in addition to the water valve 114.

Figure 13:
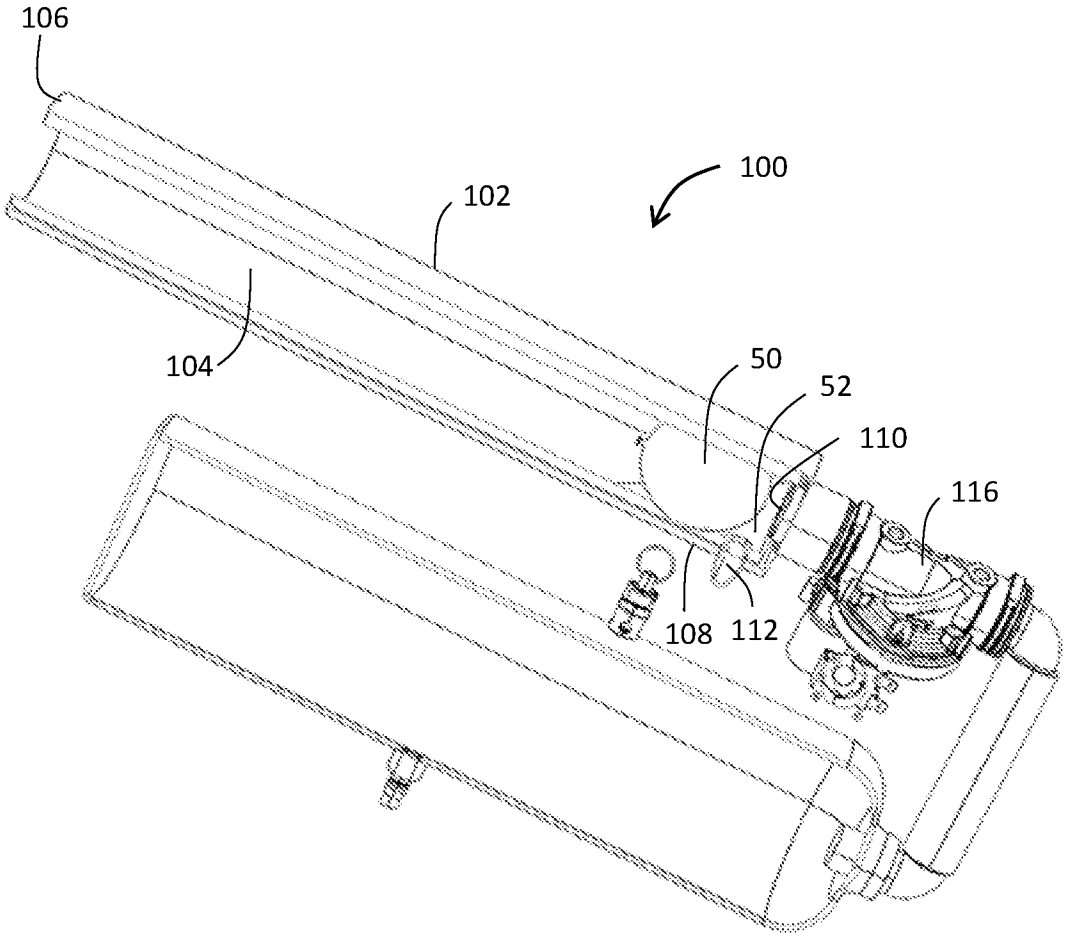
FIG. 13 is a perspective, cross-sectional view showing section AA of the water balloon cannon of FIG. 12, in accordance with an embodiment of the disclosure.

As best depicted in FIG. 13, in some embodiments, the volume of water 52 introduced into the barrel 102 can be electronically controlled. For example, the water valve 114 can be electrically switched between an open position to allow water to flow through the water port 112 and a closed position to prevent water flow. In some embodiments, the water valve 114 can be automatically transitioned from the closed position to the open position and back to the closed position over a determined length of time. When an electrical signal is detected, such as through activation of the trigger 130, the water valve 114 can be activated for a specified amount of time, allowing water to flow through the valve 114 and into the rear portion 108 of the barrel 102. In some embodiments, the determined length of time is adjustable, to enable a user to adjust the volume of water flowing through the water port 112 between launch sequences, for example, to improve accuracy or the range of the water balloon launch.

Further, in some embodiments, one or more sensors can be employed to determine a volume of water 52 present within the rear portion 108. In some embodiments, it may be desirous to fill the rear portion 108 with a sufficient volume of water 52 to cover or fully submerge the compressed air port 110, thereby providing a sufficient buffer between the shock of compressed air exiting the compressed air port 110 and the water balloon 50. Accordingly, the ideal or preferred volume of water 52 may vary depending upon the muzzle elevation, and can range from between about 100 mL to about 360 mL.

Figure 9:
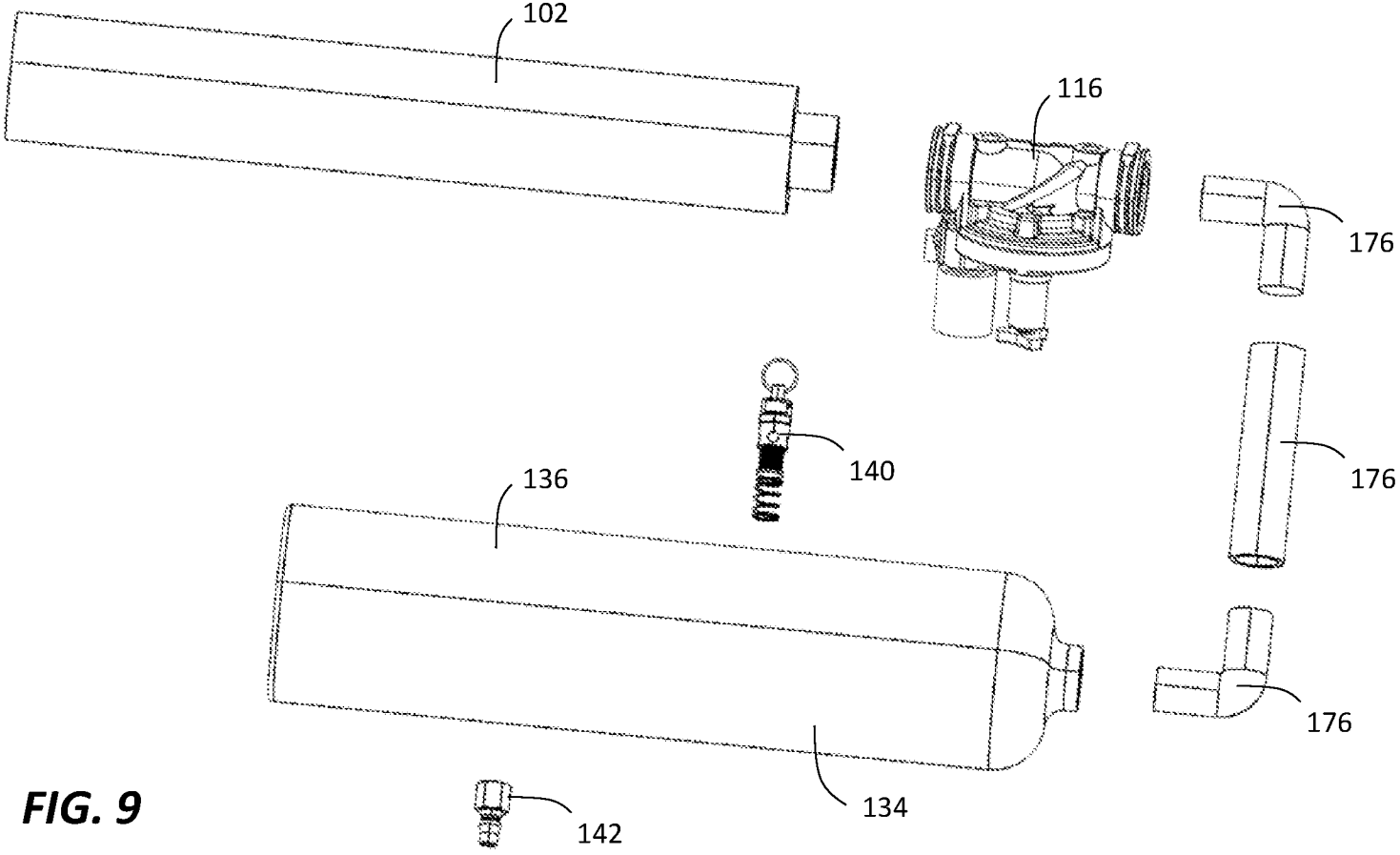
FIG. 9 is an exploded, perspective view depicting compressed air components of a water balloon cannon, in accordance with an embodiment of the disclosure.
Figure 10:
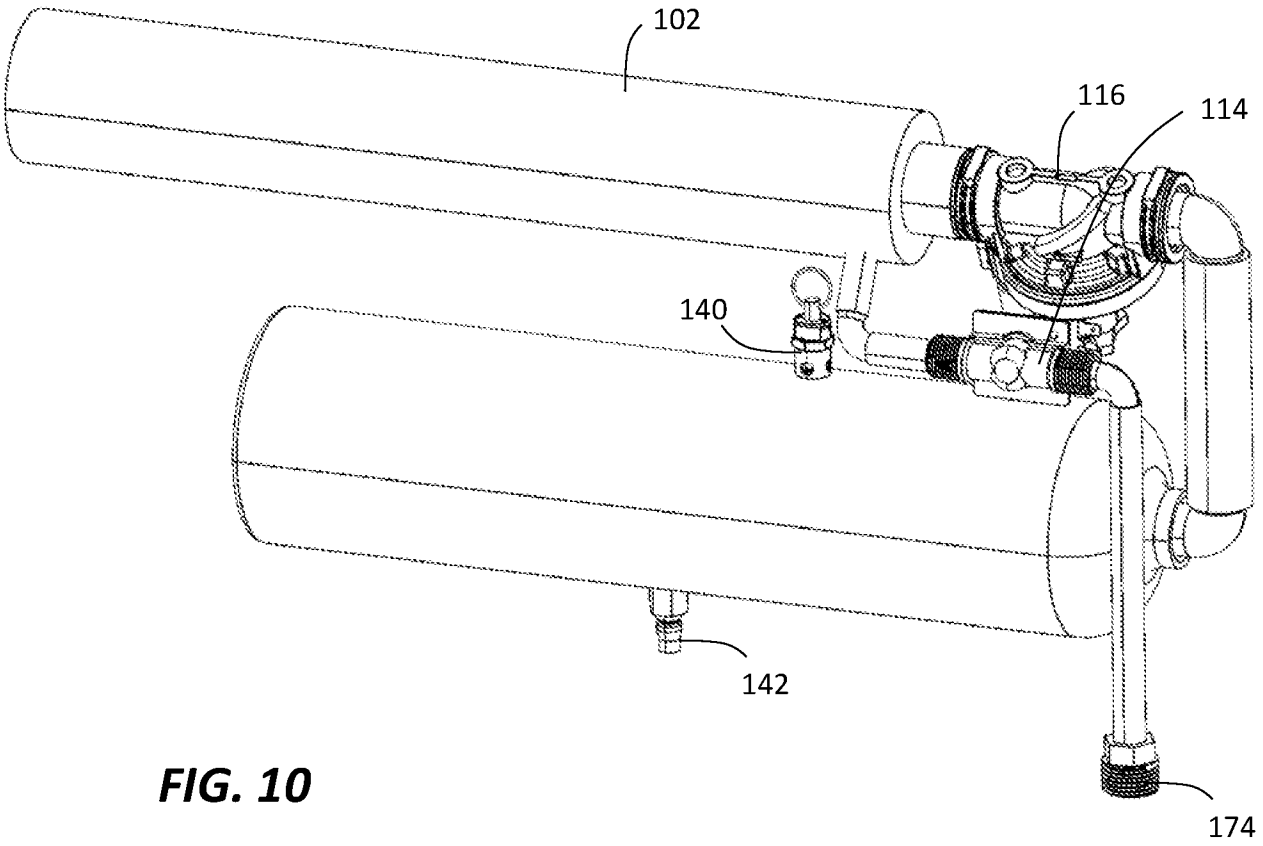
FIG. 10 is a perspective view depicting compressed air and water source components of a water balloon cannon, in accordance with an embodiment of the disclosure.

Referring to FIG. 9, the air valve 116 provides a fluid connection between the barrel 102 and a compressed air source 134, which can be an air recharge tank 136 or an air compressor 138, either of which can be in fluid communication with the air valve 116. For example, in some embodiments, the air recharge tank 136 can include an inlet 142 (e.g., quick disconnect air coupler nipple, etc.), allowing for easy connection and disconnection from an external air source, such as a pneumatic hose connected to an external compressed air source, such as an air compressor. In embodiments, the air recharge tank 136 can be constructed of a noncorrosive material, and can be fully operational with the capacity of 1 gallon or less, though the use of other tank sizes is also contemplated. One or more sections of conduit 176 can fluidly couple the air recharge tank 136 to the air valve 116.

During operation, pressurized air moves from the compressed air source to the air recharge tank 136. When the trigger 130 is pressed, the air valve 116 opens and allows the pressurized air to flow through the air valve 116, the compressed air port 110, and into the rear portion 108 of the barrel 102. Upon release of the trigger 130, the air valve 116 closes, allowing the air recharge tank 136 to be recharged to the pressure set by the air compressor. In some embodiments, the air valve 116 is electrically controlled (e.g., via a solenoid or the like) and can be transitioned between an open position to allow air to flow through the compressed air port 110 and a closed position to prevent or inhibit air flow.

The air valve 116 can also be automatically transitioned from the closed position to the open position and back to the closed position over a determined length of time. In some embodiments, a user can adjust the length of time to change the flow rate or volume of compressed air flowing through the compressed air port 110 during a launch sequence, for example, to optimize accuracy or the range of the water balloon launch. This allows for greater control over the performance of the water balloon cannon 100.

In some embodiments, the air recharge tank 136 is equipped with a pressure relief safety valve 140. If the pressure in the air recharge tank 136 reaches an unsafe level, the pressure relief safety valve 140 opens to release the excess pressure and closes once the air recharge tank 136 returns to a safe level. This provides an added layer of safety in the event of a pressure buildup in the air recharge tank 136. In some embodiments, the air recharge tank 136 can be equipped with a pressure regulator to regulate the pressure of the air flowing into and out of the air recharge tank 136, providing further control and safety.

Figure 15:
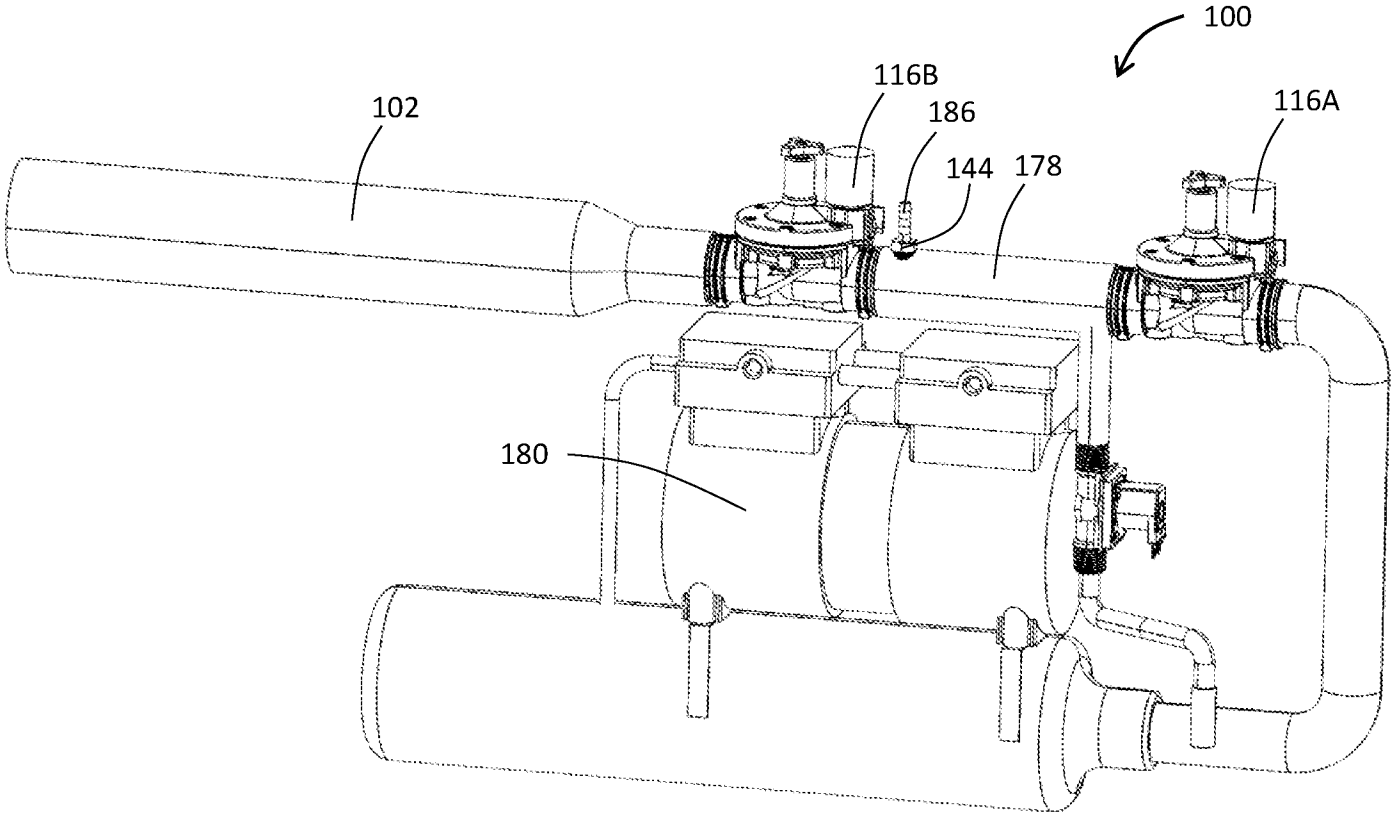
FIG. 15 is a perspective view of a water balloon cannon including a discrete water holding chamber, in accordance with an embodiment of the disclosure.

In embodiments, the water balloon cannon 100 is designed to operate at pressures below 100 psi, although other operating pressures are also possible. For example, at a nominal operating pressure of 60 psi (e.g., or between about 40-50 psi), the water balloon cannon 100 is capable of launching a water balloon a distance of between 150 and 200 feet. The water balloon cannon 100 can also include a pressure sensor 144 (as depicted in FIG. 15) to monitor the pressure inside the air recharge tank 136, and in some cases temporarily limit or disable the water balloon cannon 100 if the pressure reaches an unsafe level to ensure that the water balloon cannon 100 operates within safe pressure levels, further enhancing its safety and reliability.

Figure 14:
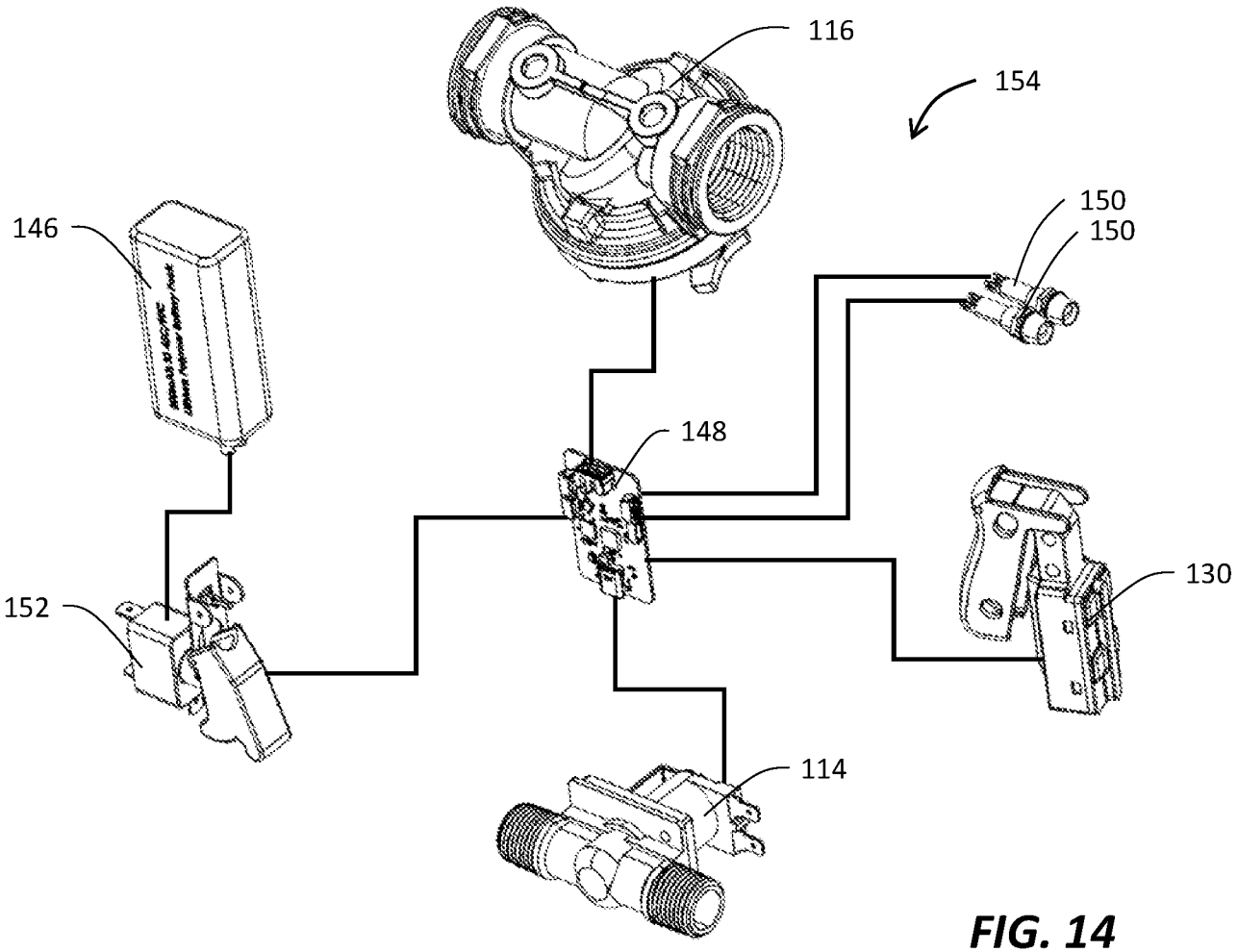
FIG. 14 is an electrical schematic diagram of a water balloon cannon, in accordance with an embodiment of the disclosure.

Referring to FIG. 14, a schematic diagram of an electrical system 154 of a water balloon cannon 100 is depicted in accordance with an embodiment of the disclosure. In embodiments, the electrical system 154 can include a trigger 130, system indicator lights 150, a relay, controller, or timing circuit 148, and a power supply, such as a battery or fixed power source, and power switch 152.

In embodiments, the water balloon cannon 100 can be powered by a battery 146 or other power source that provides electrical power to components such as the water valve 114, air valve 116, timing circuit 148, indicator lights 150, or other electrical components. In some embodiments, the battery 146 can be removable and rechargeable. The timing circuit 148 can be configured to open the air valve 116 for a first length of time and subsequently open the water valve 114 for a second length of time. The power switch 152 can be used to selectively disconnect the battery 146 and electrical components, preserving the life of the battery and serving as a safety feature to isolate the power source from a short circuit. The indicator lights 150 can be used to indicate the status of the water balloon cannon 100. For example, in one embodiment, the first indicator light 150A can be illuminated when the system is in the launch sequence and the second indicator light 150B can indicate that the system is ready for a launch.

During operation, the user presses the trigger 130 which sends an electrical signal to the timing circuit 148. The timing circuit 148 then sends an electrical signal to the air valve 116, causing the air valve 116 to open for a preprogrammed amount of time. The timing circuit 148 then closes the air valve 116, and the timing circuit 148 opens the water valve 114 for a predetermined length of time to fill the rear portion 108 with water. The timing circuit 148 then closes the water valve 114 and the second indicator light 150B illuminates to indicate that the system is ready for a new cycle.

Figure 16:
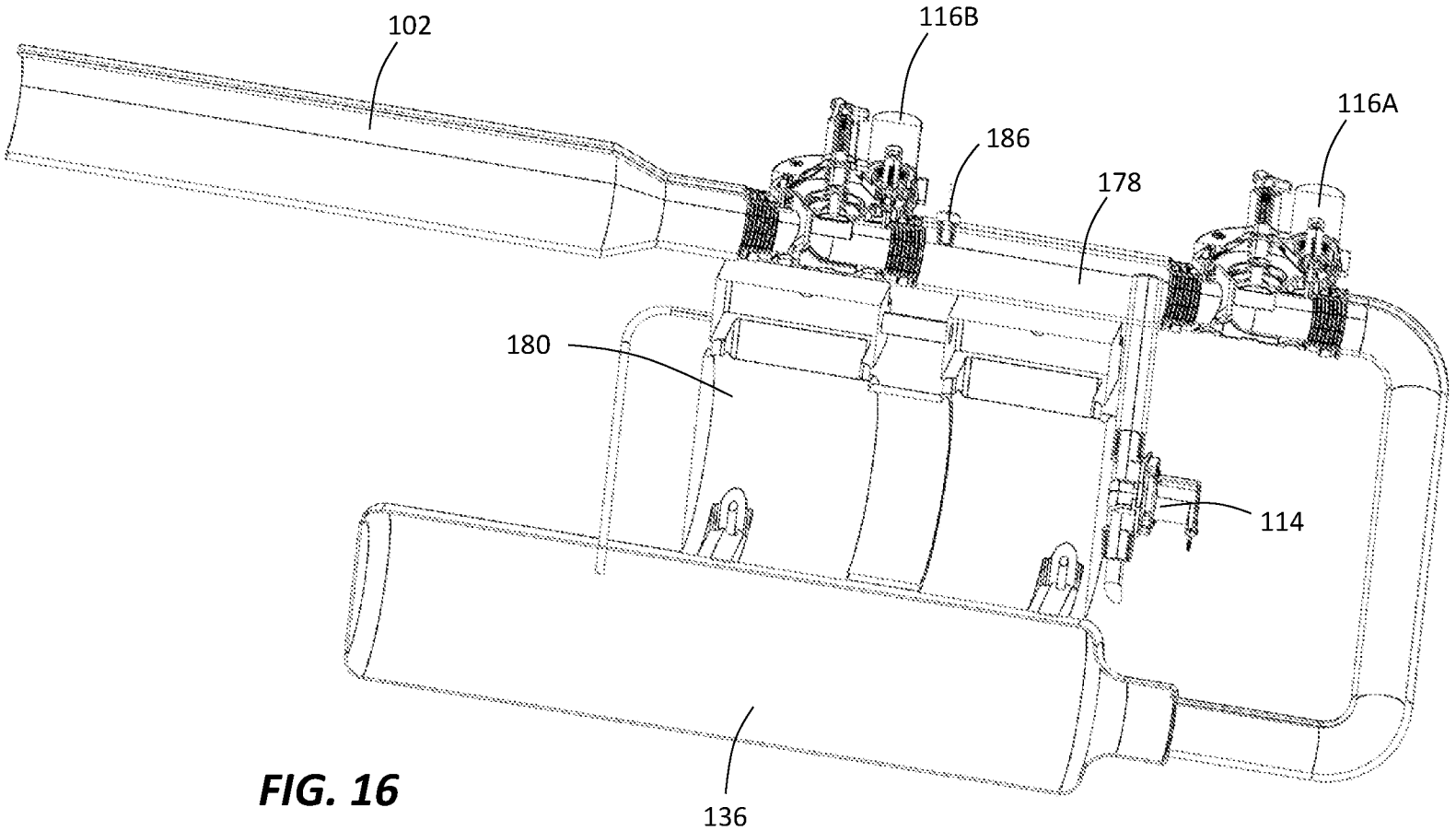
FIG. 16 is a cross-sectional view depicting the water balloon cannon of FIG. 15, in accordance with an embodiment of the disclosure.
Figure 17:
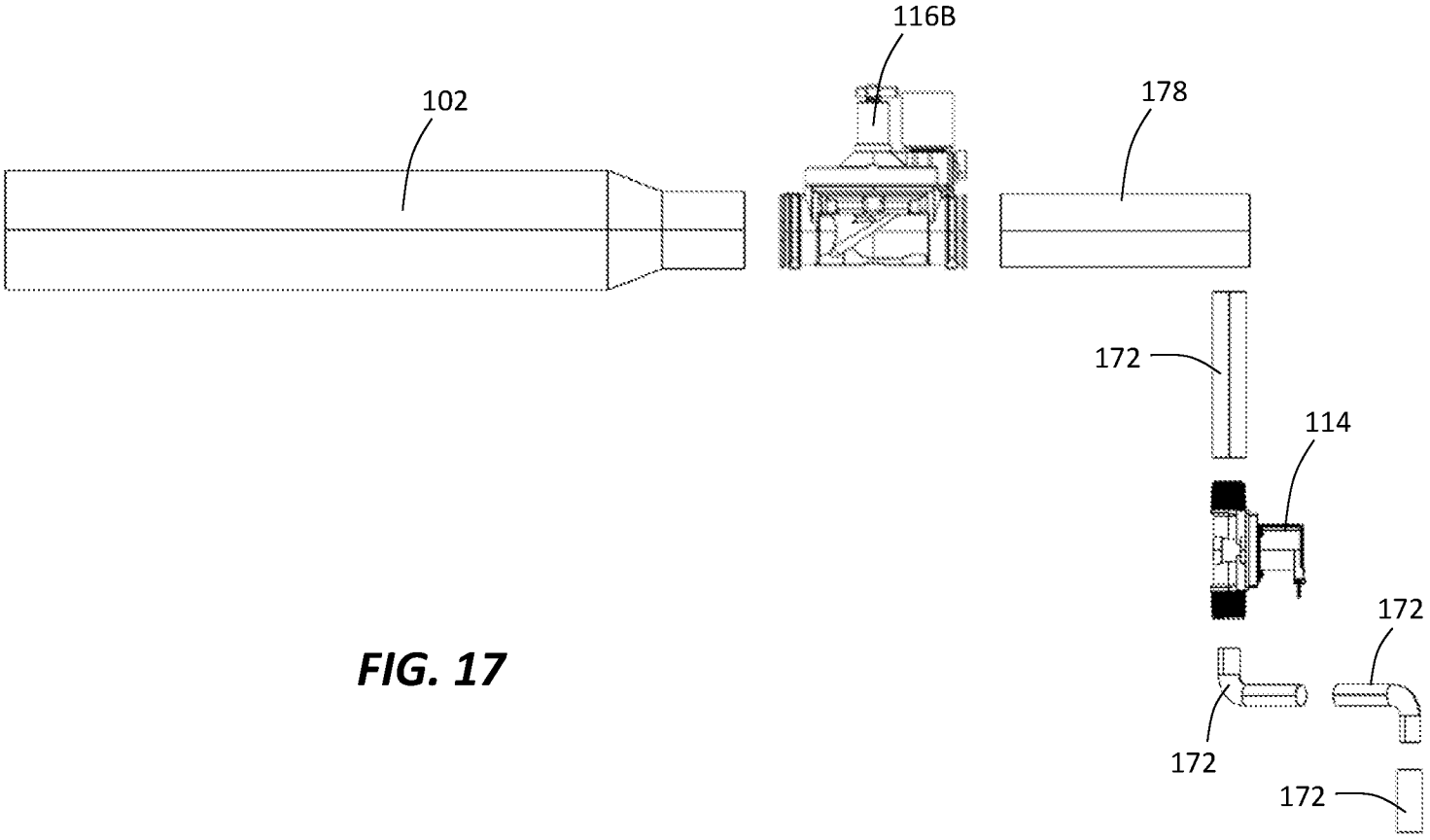
FIG. 17 is an exploded, left side plan view depicting water source components of a water balloon cannon including a water holding chamber, in accordance with an embodiment of the disclosure.
Figure 18:
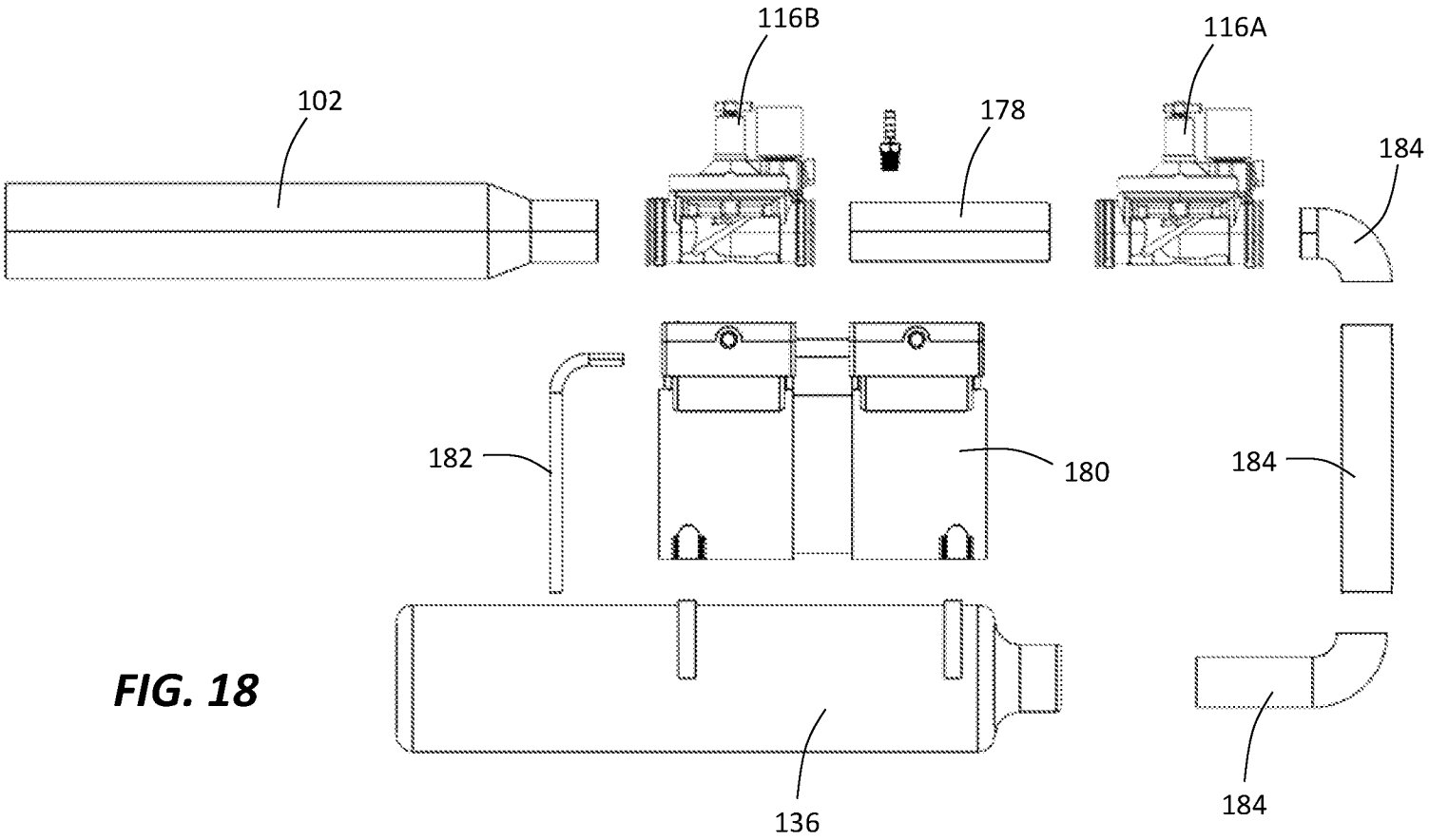
FIG. 18 is an exploded, left side plan view depicting compressed air components of a water balloon cannon including a water holding chamber, in accordance with an embodiment of the disclosure.

FIGS. 16-18 depict an alternative embodiment of the water balloon cannon 100, including a water holding chamber 178 positioned between a first air valve 116A and a second air valve 116B. Given the relatively low pressures involved (e.g., 30-60 psi, etc.), in some embodiments, the water balloon cannon 100 can further be equipped with an internal air compressor 180, thereby alleviating the need to connect the water balloon cannon 100 to an external source of compressed air, which in some embodiments can be battery powered.

Referring to FIG. 17, the water holding chamber 178, can be fluidly coupled to the water valve 114, for example via conduit 172, thereby enabling the water holding chamber 178 to be selectively filled with a volume of water from a water source 132 (e.g., pressurized garden hose, attached water tank, etc.). In embodiments, the water holding chamber 178 can include a vent 186 configured to enable air to escape the water holding chamber 178 as water fills the water holding chamber 178.

Referring to FIG. 18, the internal air compressor 180 can be fluidly coupled to the air recharge tank 136, for example via conduit 182, so as to maintain a supply of compressed air within the air recharge tank 136 for use during operation. The air recharge tank 136 can in turn be operably coupled to the first air valve 116A via one or more sections of conduit 184. The first air valve 116A can be configured to transition between a closed position and an open position, thereby enabling a flow of compressed air from the air recharge tank 136 into the water holding chamber 178. Thereafter (e.g., upon pressing the trigger 130, etc.), the second air valve 116B can transition from a closed position to an open position, thereby enabling the contents of the water holding chamber 178 (e.g., a volume of water and compressed air, etc.) to be discharged from the water holding chamber 178 and into the rear portion 108 of the barrel 102, which in turn causes a water balloon 50 positioned within the barrel 102 to be launched.

Figure 19:
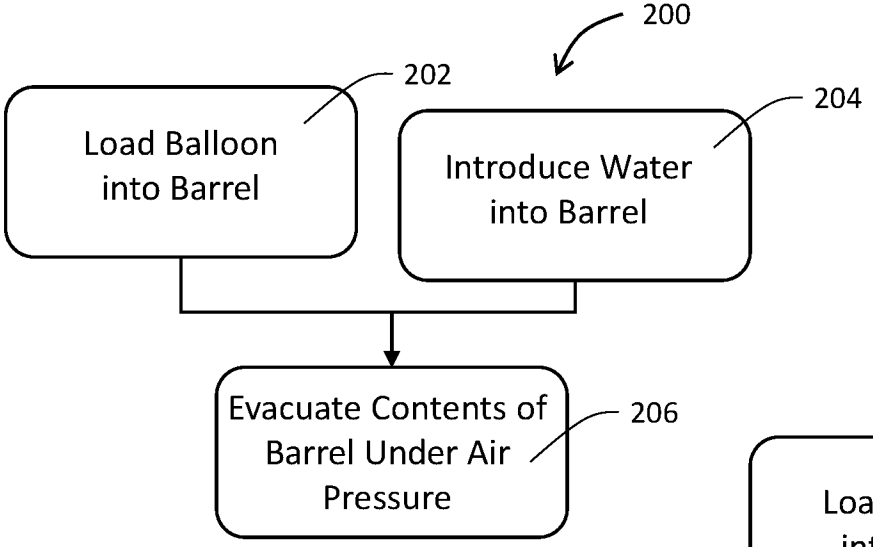
FIG. 19 is a method of firing a water balloon cannon, in accordance with an embodiment of the disclosure.
Figure 21:
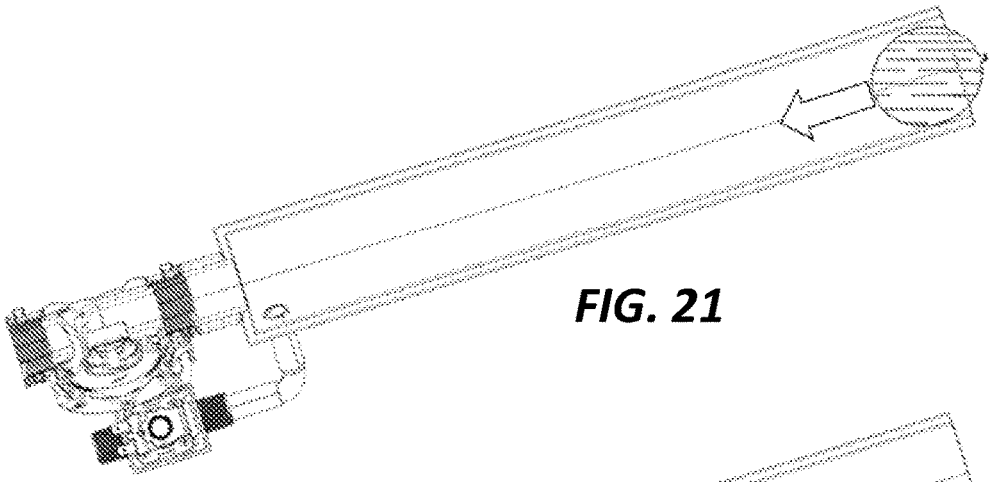
FIG. 21 depicts loading of a water balloon into a water balloon cannon, in accordance with an embodiment of the disclosure.

Referring to FIG. 19, a method 200 of launching a water balloon is depicted in accordance with an embodiment of the disclosure. According to this embodiment, at step 202, a water balloon 50 can be loaded into the barrel 102 of the water balloon cannon 100. For example, in some embodiments, the water balloon 50 can be passed through the muzzle 106 of the barrel 102 (as depicted in FIG. 21), and either be forcibly pushed or fall under the weight of gravity to a rear portion 108 of the barrel 102, in proximity to a water port 112 and a compressed air port 110 positioned therein.

Figure 22:
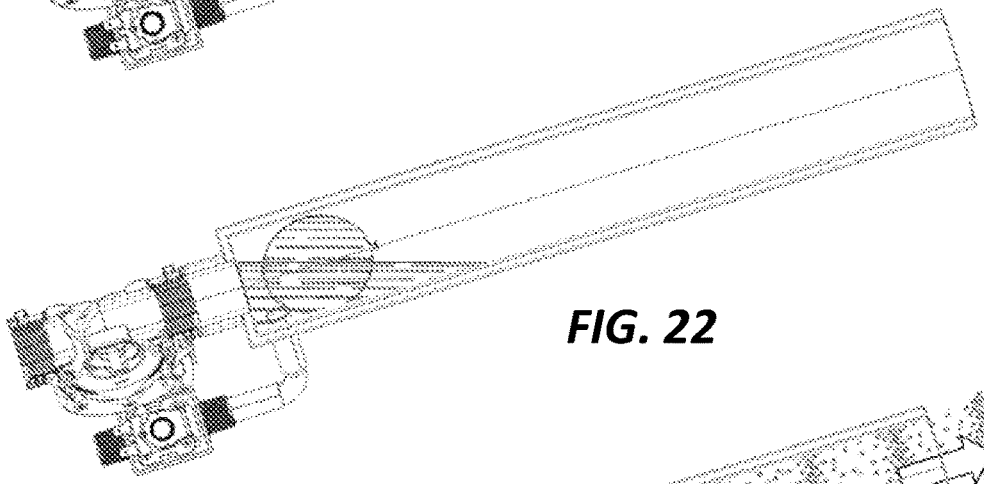
FIG. 22 depicts an introduction of water around the water balloon of FIG. 21, in accordance with an embodiment of the disclosure.

At step 204, a volume of water 52 can be introduced into the rear portion 108 of the barrel 102, for example via the water port 112 (as depicted in FIG. 22). In some embodiments, the volume of water 52 can be of sufficient volume to generally cover the compressed air port 110, which can be dependent upon the muzzle elevation, barrel diameter, etc., to provide a buffer between a rush of compressed air exiting the compressed air port 110 and the water balloon 50.

Figure 23:
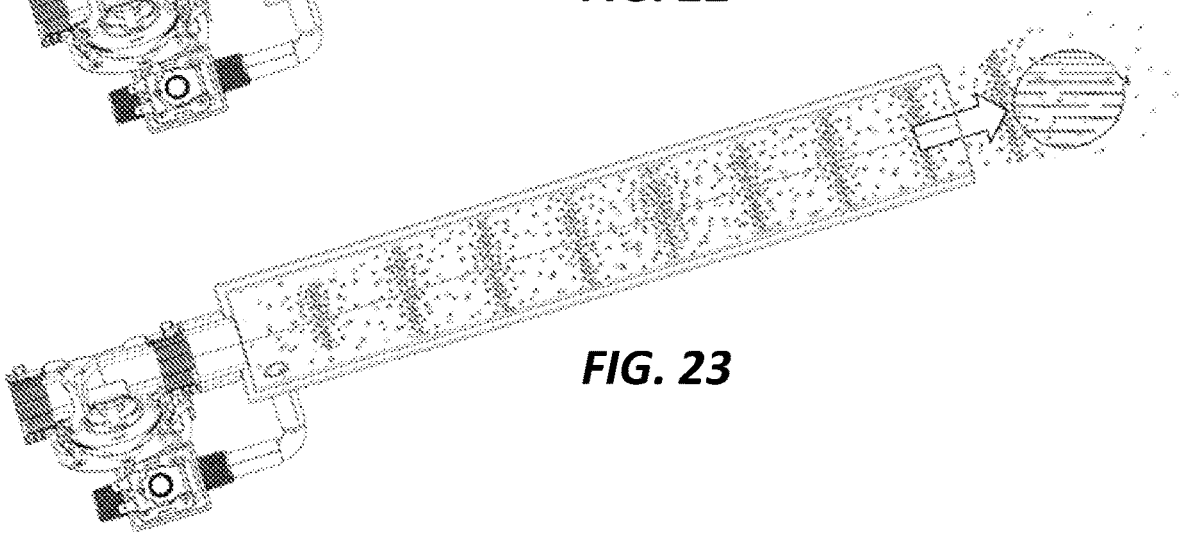
FIG. 23 depicts ejection of the water and water balloon of FIG. 22, in accordance with an embodiment of the disclosure.

At step 206, a flow of compressed air can be introduced into the rear portion 108 of the barrel 102, for example via the compressed air port 110, thereby expelling or launching the contents of the barrel 102 (e.g., a water balloon 50 and volume of water 52, etc.) through the muzzle 106 (as depicted in FIG. 23). In embodiments, the volume of water 52 can serve as a buffer between air rushing out of the compressed air port 110 and the water balloon 50 during the launch sequence. The sequence of steps 202 and 204 is not important, provided that steps 202 and 204 are completed before step 206.

Figure 20:
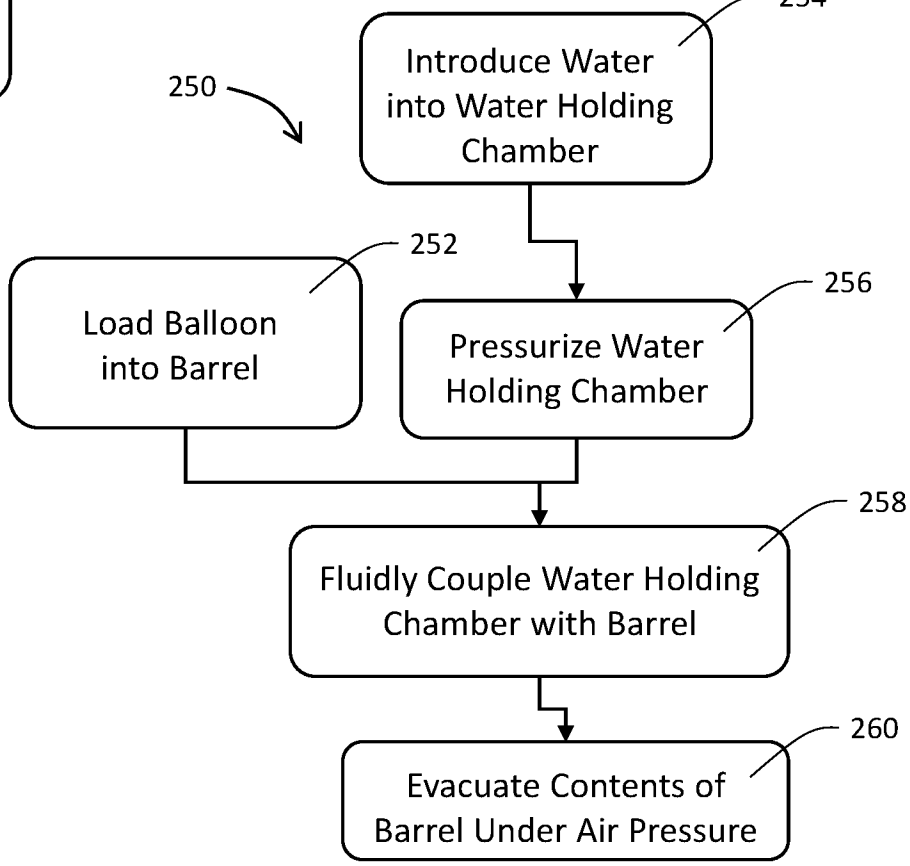
FIG. 20 is an alternative method of firing a water balloon cannon, in accordance with an embodiment of the disclosure.
Figure 24:
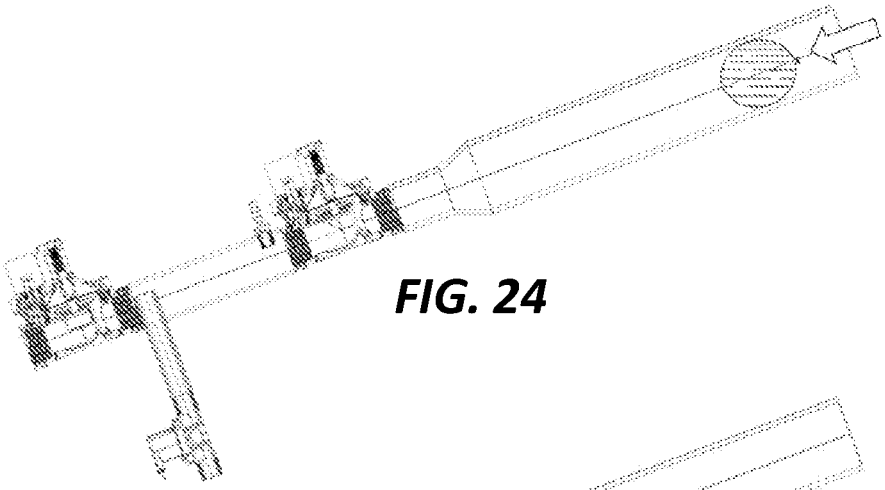
FIG. 24 depicts loading of a water balloon into a water balloon cannon, in accordance with an embodiment of the disclosure.
Figure 25:
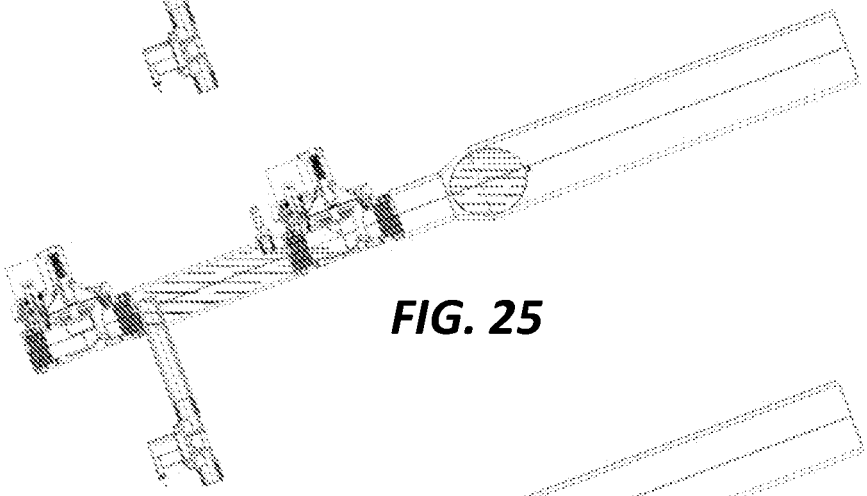
FIG. 25 depicts an introduction of water into a water holding chamber of the water balloon cannon of FIG. 24, in accordance with an embodiment of the disclosure.

Referring to FIG. 20, an alternative method 250 of launching a water balloon is depicted in accordance with an embodiment of the disclosure. According to this embodiment, at step 252 a water balloon 50 can be loaded into the barrel 102 of the water balloon cannon 100 (as depicted in FIG. 24), similar to the methods previously described herein. At step 254, a volume of water 52 can be introduced into a water holding chamber 178, for example via the water port 112 (as depicted in FIG. 25).

Figure 26:
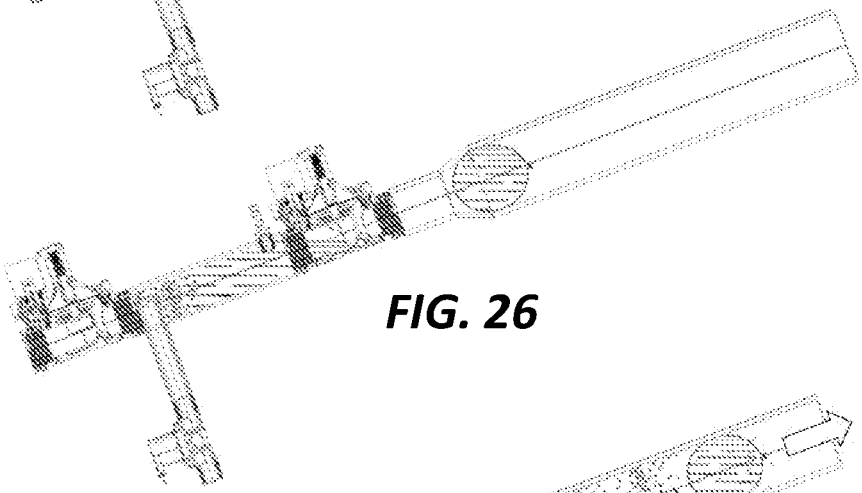
FIG. 26 depicts an introduction of compressed air into the water holding chamber of FIG. 25, in accordance with an embodiment of the disclosure.

At step 256, a first air valve 116A can be opened, thereby pressurizing the water holding chamber 178 with a charge of compressed air (as depicted in FIG. 26). The sequence of steps 252 and 254 is not important, provided that steps 252 and 254 are completed before step 256.

Figure 27:
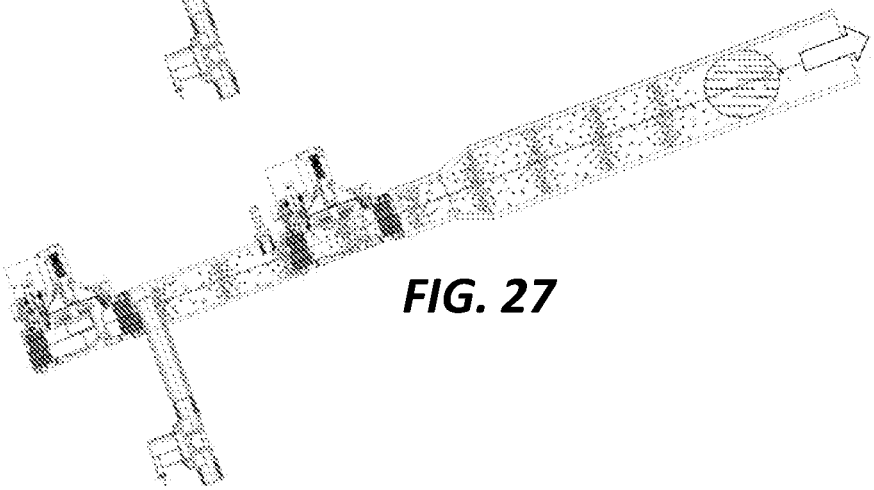
FIG. 27 depicts ejection of the water and water balloon from the water balloon cannon of FIG. 26, in accordance with an embodiment of the disclosure.

At step 258, a second air valve 116B can be opened, thereby fluidly coupling the water holding chamber 178 with the barrel 102, thereby enabling the contents of the water holding chamber 178 (e.g., a volume of water 52 and compressed air, etc.) to be evacuated into the barrel 102. At 260, the compressed air and volume of water continued to pass through the water holding chamber 178 and barrel 102, thereby expelling or launching the water balloon through the muzzle 106 (as depicted in FIG. 27).

Having described the preferred aspects and implementations of the present disclosure, modifications and equivalents of the disclosed concepts may readily occur to one skilled in the art. However, it is intended that such modifications and equivalents be included within the scope of the claims which are appended hereto.

What is claimed is:

1. A water balloon cannon comprising:

a barrel defining a bore diameter sized to receive a water balloon and extending between a muzzle and a rear portion, the rear portion defining a compressed air port and a water port;

a water valve; and a timing circuit electrically coupled to the water valve, wherein the timing circuit is configured to open the water valve for a determined length of time to introduce a volume of water through the water port into the rear portion of the bore diameter.

2. The water balloon cannon of claim 1, further comprising an air valve configured to introduce a flow of air through the compressed air port into the rear portion of the bore diameter.

3. The water balloon cannon of claim 2, wherein the volume of water is configured to provide a buffer between the flow of compressed air through the compressed air port and a water balloon positioned within the bore diameter.

4. The water balloon cannon of claim 1, wherein the water valve provides a conduit fluidly coupling the barrel with a water source.

5. The water balloon cannon of claim 4, wherein the water source is at least one of a pressurized water hose or a replenishable water tank.

6. The water balloon cannon of claim 1, wherein the water valve is electrically controllable between an open position enabling a flow of water through the water port, and a closed position inhibiting a flow of water through the water port.

7. The water balloon cannon of claim 1, wherein the air valve provides a conduit fluidly coupling the barrel with a compressed air source.

8. The water balloon cannon of claim 1, wherein the water valve is automatically transitioned from the closed position to the open position and back to the closed position over the determined length of time.

9. The water balloon cannon of claim 1, further comprising a battery configured to provide electrical power to at least one of the water valve, an air valve, a timing circuit, one or more indicator lights, or air compressor.

10. The water balloon cannon of claim 1, further comprising a trigger for activation of the timing circuit, wherein the timing circuit is electrically coupled to an air valve, wherein activation of the trigger causes the air valve to open for a determined length of time.

11. A water balloon cannon, comprising:

a barrel defining a bore diameter sized to receive a water balloon and extending between a muzzle and a rear portion, the rear portion defining a compressed air port and a water port;

air valve configured to introduce a flow of air through the compressed air port into the rear portion of the bore diameter; and a water valve configured to introduce a volume of water through the water port into the rear portion of the bore diameter, wherein the volume of water is configured to provide a buffer between the flow of compressed air through the compressed air port and a water balloon positioned within the bore diameter; and a timing circuit electrically coupled to the air valve and the water valve, wherein the timing circuit is configured to open the air valve for a determined length of time, and subsequently to close the air valve and open the water valve for a determined length of time.

12. The water balloon cannon of claim 11, wherein the water valve provides a conduit fluidly coupling the barrel with a water source.

13. The water balloon cannon of claim 12, wherein the water source is at least one of a pressurized water hose or a replenishable water tank.

14. The water balloon cannon of claim 11, wherein the water valve is electrically controllable between an open position enabling a flow of water through the water port, and a closed position inhibiting a flow of water through the water port.

15. The water balloon cannon of claim 11, wherein the air valve provides a conduit fluidly coupling the barrel with a compressed air source.

16. The water balloon cannon of claim 11, wherein the water valve is automatically transitioned from the closed position to the open position and back to the closed position over the determined length of time.

17. The water balloon cannon of claim 11, further comprising a battery configured to provide electrical power to at least one of the water valve, an air valve, a timing circuit, one or more indicator lights, or air compressor.

18. A water balloon launching apparatus comprising:

a barrel with a bore diameter designed to accommodate a water balloon, extending from a muzzle to a rear section, where the rear section includes a compressed air port and a water port;

a water valve coupling the barrel to a water supply, wherein the water valve is electrically operable between an open position allowing a flow of water through the water port into the rear section of the bore diameter, and a closed position inhibiting the flow of water through the water port, an air valve coupling the barrel to a compressed air source, wherein the air valve is electrically operable between an open position allowing a flow of compressed air through the compressed air port into the rear section of the bore diameter, and a closed position inhibiting the flow of compressed air through the compressed air port; and a trigger and timing circuit electrically coupled to the air valve and the water valve, wherein activating the trigger opens the air valve, and releasing the trigger opens the water valve for a determined duration to enable a volume of between 100 mL and 360 mL of water to pass through the water valve into the rear section of the bore diameter to serve as a buffer between a water balloon positioned within the bore diameter and the compressed air entering the rear section of the bore diameter through the compressed air port.

19. The water balloon launching apparatus of claim 18, further comprising:

at least one indicator light configured to illuminate when the water balloon cannon is ready to be fired.

* * * * *